US011555278B2

(12) United States Patent
Ellwein et al.

(10) Patent No.: US 11,555,278 B2
(45) Date of Patent: Jan. 17, 2023

(54) AUTOWIDTH INPUT FOR PAVING OPERATIONS

(71) Applicants: Caterpillar Paving Products Inc., Brooklyn Park, MN (US); Caterpillar Trimble Control Technologies LLC, Dayton, OH (US)

(72) Inventors: Jacob Ellwein, Oak Grove, MN (US); Mark Tarvin, Canton, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 757 days.

(21) Appl. No.: 16/505,417

(22) Filed: Jul. 8, 2019

(65) Prior Publication Data

US 2021/0010210 A1 Jan. 14, 2021

(51) Int. Cl.
*E01C 19/48* (2006.01)
*E01C 19/00* (2006.01)

(52) U.S. Cl.
CPC ..... *E01C 19/004* (2013.01); *E01C 19/4866* (2013.01); *E01C 2301/16* (2013.01)

(58) Field of Classification Search
CPC .... E01C 19/004; E01C 19/48; E01C 19/4866; E01C 2301/16
USPC ..... 404/72, 75, 84.05–84.5, 118; 701/1–10
See application file for complete search history.

(56) References Cited

U.S. PATENT DOCUMENTS 5,588,776 A 12/1996 Swisher, Jr. et al.
7,946,787 B2 5/2011 Glee et al.
9,045,871 B2 6/2015 Graham et al.
9,670,629 B2 6/2017 Buschmann et al.
9,797,099 B2 10/2017 Engels et al.
9,932,714 B2 4/2018 Graham et al.
9,963,836 B1 * 5/2018 Brenner ..... E01C 19/42
2012/0288328 A1 * 11/2012 Minich ..... E01C 19/48 404/72
2018/0155883 A1 6/2018 Engels et al.
2019/0106846 A1 * 4/2019 Marsolek ..... E01C 19/23
2019/0338473 A1 * 11/2019 Buschmann ..... H04W 4/023
2020/0018634 A1 * 1/2020 Fickeisen ..... E01C 19/48
2020/0117201 A1 * 4/2020 Oetken ..... B64C 39/024
2020/0270823 A1 * 8/2020 Brieskorn ..... E01C 19/187
2020/0292348 A1 * 9/2020 Chambers ..... G01C 21/3682

FOREIGN PATENT DOCUMENTS

CN 105157646 B 8/2018

* cited by examiner

*Primary Examiner* — Raymond W Addie
(74) *Attorney, Agent, or Firm* — Harrity & Harrity, LLP

(57) ABSTRACT

A paving machine may include a frame, a screed, sensor devices, and a control unit. The screed may include a main section, a first extension, and a second extension. The sensor devices may output a first sensor signal corresponding to a position of the first extension and a second sensor signal corresponding to a position of the second extension. The control unit may receive the first and second sensor signals, determine a screed width based on the first and second sensor signals, receive location data corresponding to a location of the paving machine, determine locations of the first and second extensions based on the screed width and the location data, generate a boundary map based on the locations of the first and second extensions, and cause an action to be performed based on the boundary map.

20 Claims, 4 Drawing Sheets

| Time | Screed Width | Screed Location | Screed Orientation | Extension Locations |
|---|---|---|---|---|
| $t_1$ | $w_1$ | $x_1, y_1$ | $b_1$ | $x_{11}, y_{11}; x_{12}, y_{12}$ |
| $t_2$ | $w_2$ | $x_2, y_2$ | $b_2$ | $x_{21}, y_{21}; x_{22}, y_{22}$ |
| $t_3$ | $w_3$ | $x_3, y_3$ | $b_3$ | $x_{31}, y_{31}; x_{32}, y_{32}$ |
| ... | ... | ... | ... | ... |

AUTOWIDTH INPUT FOR PAVING OPERATIONS

TECHNICAL FIELD

The present disclosure relates generally to paving machines and, for example, to an autowidth input for paving operations.

BACKGROUND

Paving machines are used to spread and compact a mat of paving material relatively evenly over a desired work surface. Paving machines are regularly used to pave roads, parking lots, and other areas where a smooth durable surface is desired. A paving machine generally includes a hopper assembly to receive the paving material (e.g., asphalt and/or another bituminous aggregate material) from a supply machine (e.g., a supply truck, a windrow elevator, a material transfer vehicle, and/or the like), and a conveyor system to transfer the paving material rearwardly from the hopper assembly for discharge onto the work surface. A screw auger may be used to spread the paving material transversely across the work surface in front of a screed assembly. The screed assembly smoothes and partially compacts the paving material, leaving a mat of uniform depth and smoothness. A compactor machine typically follows the paving machine to further compact the mat laid by the paving machine.

In a paving operation using automated machine guidance (AMG), one or more of the paving machine, the compactor, and/or another work machine may be autonomous, semi-autonomous, or manually operated according to a predetermined site plan. The site plan may be determined based on a multi-dimensional digital model of the work surface, and updated using real-time positioning data of the work machines provided by a positioning system. The positioning system can also be used to help track the progress of the paving operation and guide the work machines accordingly. Additional data input from individual work machines (e.g., a screed width, a screed height, a crown angle, and/or another parameter), if obtained reliably and efficiently, can also be helpful to reinforce the positioning data and enhance machine guidance.

During a paving operation, it is common to change the effective width of the screed assembly to account for changes in the width of the work surface. Within an AMG environment, the change in screed width is typically measured (e.g., by hand and using a tape measure), and manually entered into a three-dimensional grade control of the paving machine to help ensure the mat is aligned to the work surface. However, the change in screed width is not always correctly updated in the three-dimensional grade control of the paving machine, which can result in errors in the work surface being paved. Unreliable screed width input can also adversely affect guidance of other work machines, and hinder the ability to track yield (e.g., an amount or volume of paving material used) or other aspects related to the progress of the paving operation. Furthermore, manual measurement and/or entry of the screed width can be time consuming and inefficient.

One attempt to facilitate a paving operation within an automated environment is disclosed in U.S. Pat. No. 9,797,099 that issued to Engels, et al. on Oct. 24, 2017 ("the '099 patent"). In particular, the '099 patent discloses a slipform paving machine with a concrete mold having a variable mold width. The '099 patent discloses receiving from a width sensor a width signal corresponding to a change in the mold width, and controlling a width actuator in response to the width signal to facilitate the adjustment of the mold width. While the slipform paving machine of the '099 patent may use a width sensor to locally adjust concrete mold width during operation, the '099 patent does not disclose guiding other work machines or making assessments useful for tracking yield or other aspects of the paving operation.

A paving system of the present disclosure solves one or more of the problems set forth above and/or other problems in the art.

SUMMARY

According to some implementations, a method may include receiving, by a device and from a paving machine, screed width data corresponding to a width of a screed of the paving machine; receiving, by the device, location data corresponding to a location of the paving machine; determining, by the device, an orientation of the screed based on the location data; determining, by the device, a location of a first extension of the screed based on the screed width data, the location data, and the orientation of the screed; determining, by the device, a location of a second extension of the screed based on the screed width data, the location data, and the orientation of the screed; determining, by the device, a first boundary of a mat based on the location of the first extension; determining, by the device, a second boundary of the mat based on the location of the second extension; generating, by the device, a boundary map based on the first boundary and the second boundary; and causing, by the device, an action to be performed based on the boundary map.

According to some implementations, a device may include one or more memories; and one or more processors, communicatively coupled to the one or more memories, to receive screed width data corresponding to a width of a screed of a paving machine; receive location data corresponding to a location of the paving machine; determine a location of a first extension of the screed based on the screed width data and the location data; determine a location of a second extension of the screed based on the screed width data and the location data; determine a first boundary of a mat based on the location of the first extension; determine a second boundary of the mat based on the location of the second extension; generate a boundary map based on the first boundary and the second boundary; and cause an action to be performed based on the boundary map.

According to some implementations, a paving machine may include a frame; a screed coupled to the frame, the screed having a main section, a first extension movably coupled to a first end of the main section, and a second extension movably coupled to a second end of the main section; a set of sensor devices coupled to the screed, the set of sensor devices being configured to output a first sensor signal corresponding to a position of the first extension relative to the main section and a second sensor signal corresponding to a position of the second extension relative to the main section; and a control unit in communication with the set of sensor devices, the control unit being configured to receive the first sensor signal and the second sensor signal, determine a screed width based on the first sensor signal and the second sensor signal, receive location data corresponding to a location of the paving machine, determine a location of the first extension based on the screed width and the location data, determine a location of the second extension based on the screed width and the location data, generate a boundary map based on the location of the first extension and the location of the second extension, and cause an action to be performed based on the boundary map.

DETAILED DESCRIPTION

Figure 1:
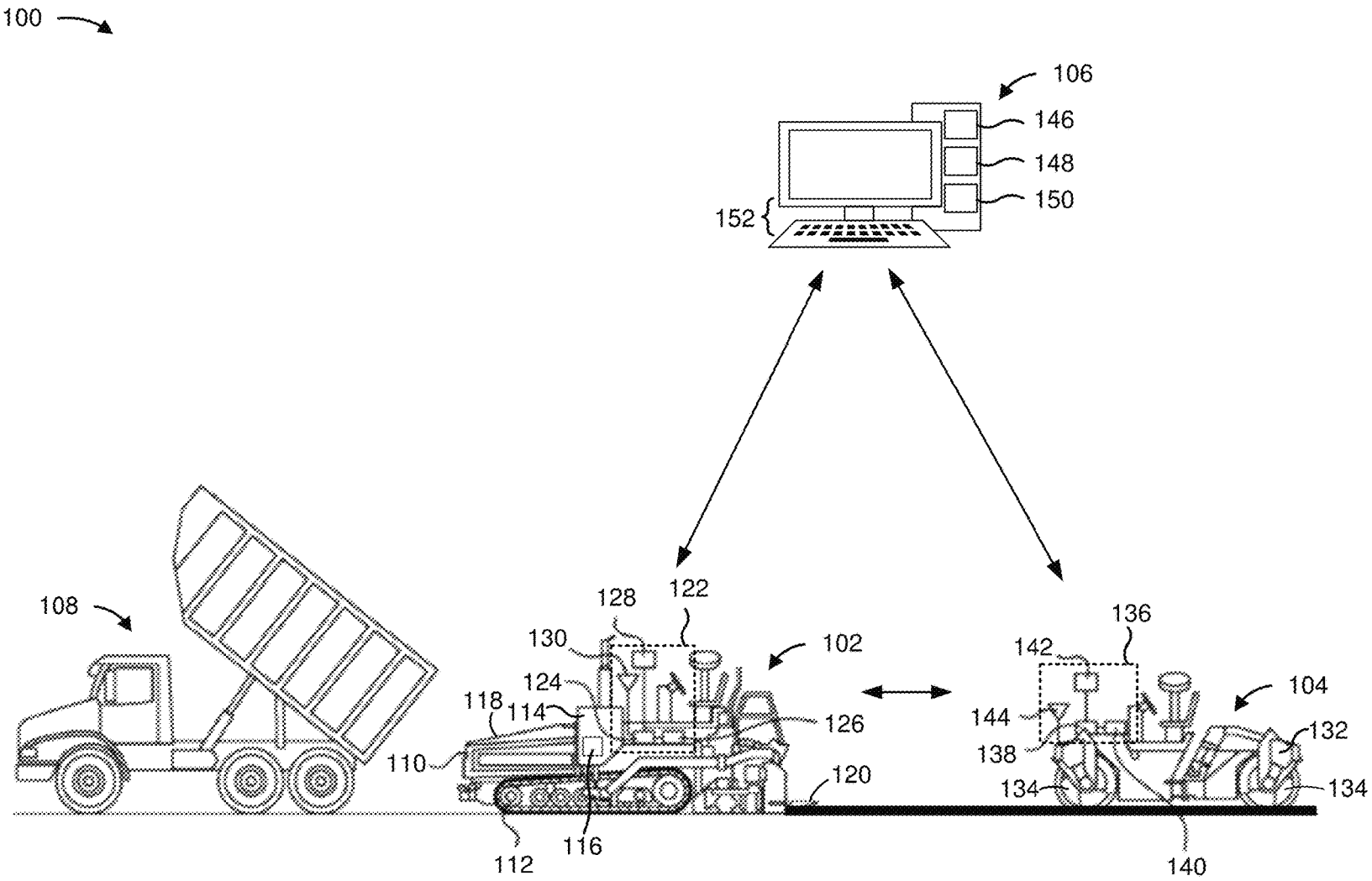
FIG. 1 is a diagram of an example paving system described herein.

FIG. 1 is a diagram of an example paving system 100 described herein. As shown in FIG. 1, paving system 100 may include a paving machine 102, a compactor machine 104, a control station 106, and/or another device or work machine configured to facilitate a paving operation. Paving system 100 may be configured to receive a paving material (e.g., asphalt and/or another bituminous aggregate material) from a supply machine 108 (e.g., a supply truck, a windrow elevator, a material transfer vehicle, and/or the like), and pave a work surface with the paving material according to a site plan (e.g., a paving plan, a compaction plan, an estimated job completion, and/or another set of instructions, specifications, commands, and/or information relating to the paving operation to be performed). In some examples, paving system 100 may include multiple paving machines 102, multiple compactor machines 104, and/or multiple control stations 106. In some cases, paving system 100 may include one or more supply machines 108.

Paving system 100 may be configured to operate autonomously or semi-autonomously based on the site plan and using location data of paving machine 102 and/or compactor machine 104. For example, one or more of paving machine 102 or compactor machine 104 may be autonomously or semi-autonomously operated or guided according to the site plan (e.g., using a two-dimensional digital model or a three-dimensional digital model of the work surface). In some examples, one or more of paving machine 102 or compactor machine 104 may be manually operated but guided according to the site plan. In some examples, control station 106 may provide operating commands and/or guidance information to paving machine 102 and/or compactor machine 104. In some examples, operating commands and/or guidance information may be communicated directly between paving machine 102 and compactor machine 104.

As further shown in FIG. 1, paving machine 102 includes a frame 110, traction elements 112, an engine 114, a generator 116, a hopper assembly 118, a screed assembly 120, and a paving control unit 122. Traction elements 112 may include wheels or tracks that are coupled to frame 110 and driven by engine 114. Generator 116 may be coupled to engine 114 and configured to supply electrical power to hopper assembly 118, screed assembly 120, and/or paving control unit 122. Hopper assembly 118 may be coupled to frame 110 and configured to transfer the paving material supplied by supply machine 108 to screed assembly 120. Screed assembly 120 may be coupled to frame 110 and configured to distribute and compact the paving material onto the work surface as a substantially uniform mat of a desired thickness and a desired width.

Paving control unit 122 includes a processor 124, a memory 126, a user interface 128, and a communication device 130. Processor 124 is implemented in hardware, firmware, and/or a combination of hardware and software capable of being programmed to perform a function associated with paving machine 102. Memory 126 includes a random-access memory (RAM), a read only memory (ROM), and/or another type of dynamic or static storage device that stores information and/or instructions to be performed by processor 124. User interface 128 includes an input device and an output device enabling an operator to specify a parameter of the paving operation (e.g., a screed height, a screed width, a crown angle, and/or the like), view a map of the work surface, access a boundary map, track a location of paving machine 102, track a location of compactor machine 104, monitor progress of the paving operation, and/or the like.

Communication device 130 includes a wireless local area network (WLAN) component (e.g., a Wi-Fi component), a radio frequency (RF) communication component (e.g., a Bluetooth component), and/or another component capable of wireless communication. Communication device 130 may enable communication with compactor machine 104, control station 106, another work machine, a network storage device associated with paving machine 102 and/or control station 106, a network computing device associated with paving machine 102 and/or control station 106, a cloud computing device associated with paving machine 102 and/or control station 106, and/or the like. For example, communication device 130 may enable processor 124 to receive a control signal (e.g., a start command, a stop command, a machine speed command, a conveyor speed command, a travel direction command, a screed width command, a screed height command, a screed crown command, and/or the like), receive a data signal from compactor machine 104, and/or the like. Communication device 130 may also enable processor 124 to transmit a control signal to compactor machine 104, and/or transmit a data signal to compactor machine 104 and/or control station 106. For example, communication device 130 may be used to transmit data corresponding to a boundary map to compactor machine 104 and/or control station 106.

Communication device 130 may also include a positioning component (e.g., a global positioning system (GPS) component, a global navigation satellite system (GNSS) component, a Universal Total Station (UTS) component, an Automatic Total Station (ATS) component, a vision-based positioning component, an RF component, and/or the like). Communication device 130 may enable processor 124 to receive and/or transmit location data corresponding to a location of paving machine 102 (e.g., relative to the work surface, relative to compactor machine 104, relative to a fixed structure of an associated work site, relative to a known point of interest (POI), and/or the like). In some cases, communication device 130 may enable processor 124 to receive location data corresponding to a location of compactor machine 104 (e.g., relative to the work surface, relative to paving machine 102, relative to a fixed structure of an associated work site, relative to a known POI, and/or the like). Communication device 130 may also enable processor 124 to transmit location data corresponding to a location of paving machine 102 to compactor machine 104 and/or control station 106, and/or transmit a location of compactor machine 104 to control station 106.

As further shown in FIG. 1, compactor machine 104 includes a frame 132, compaction elements 134 coupled to frame 132, and a compactor control unit 136. Compactor control unit 136 may be similarly configured to processor 124 of paving machine 102, and include a processor 138, a memory 140, a user interface 142, and a communication device 144. Processor 138 may be programmed to perform a function associated with compactor machine 104. Memory 140 may be configured to store information and/or instructions to be performed by processor 138. User interface 142 may include an input device and an output device enabling an operator to navigate compactor machine 104 (e.g., to follow paving machine 102), receive steering guidance, view a map of the work surface, access a boundary map, track a location of paving machine 102, track a location of compactor machine 104, monitor progress of the paving operation, and/or the like.

Communication device 144 of compactor machine 104 may be configured similarly to, and designed to be compatible with, communication device 130 of paving machine 102. Communication device 144 may enable communication with paving machine 102, control station 106, another work machine, a network storage device associated with paving machine 102 and/or control station 106, a network computing device associated with paving machine 102 and/or control station 106, a cloud computing device associated with paving machine 102 and/or control station 106, and/or the like. For example, communication device 144 may enable processor 138 to receive a control signal (e.g., a start command, a stop command, a machine speed command, a travel direction command, and/or the like). In some cases, communication device 144 may enable processor 138 to receive a data signal from paving machine 102, control station 106, a network storage device associated with paving machine 102 and/or control station 106, a network computing device associated with paving machine 102 and/or control station 106, a cloud computing device associated with paving machine 102 and/or control station 106, and/or the like, and/or the like. For example, communication device 144 may be used to receive data corresponding to a boundary map provided by paving machine 102 and/or control station 106. Communication device 144 may also enable processor 138 to transmit a control signal to paving machine 102, and/or transmit a data signal to paving machine 102 and/or control station 106.

Communication device 144 may also include a positioning component configured to receive and/or transmit location data corresponding to a location of compactor machine 104 (e.g., relative to the work surface, relative to paving machine 102, relative to a fixed structure of an associated work site, relative to a known POI, and/or the like). In some cases, communication device 144 may enable processor 138 to receive location data corresponding to a location of paving machine 102 (e.g., relative to the work surface, relative to compactor machine 104, relative to a fixed structure of an associated work site, relative to a known POI, and/or the like). Communication device 144 may also enable processor 138 to transmit location data corresponding to a location of compactor machine 104 to paving machine 102 and/or control station 106, and/or transmit a location of paving machine 102 to control station 106.

As further shown in FIG. 1, control station 106 includes a processor 146, a memory 148, and a communication device 150. In some examples, control station 106 may or may not be provided with an optional user interface 152. Similar to paving control unit 122 and compactor control unit 136, processor 146 of control station 106 may be implemented in hardware, firmware, and/or a combination of hardware and software capable of being programmed to perform a function associated with the paving operation. Memory 148 may include a random-access memory (RAM), a read only memory (ROM), and/or another type of dynamic or static storage device that stores information and/or instructions to be performed by processor 146. If provided, user interface 152 may include an input device and an output device enabling an operator to specify a parameter of the paving operation, view a map of the work surface, access a boundary map, track a location of paving machine 102, track a location of compactor machine 104, monitor progress of the paving operation, and/or the like. In some examples, user interface 152 may be provided locally relative to control station 106. Additionally, or alternatively, user interface 152 may be remotely situated from control station 106 and configured to access control station 106 via a network interface and/or the like.

Communication device 150 of control station 106 may be configured similarly to, and designed to be compatible with, communication device 130 of paving machine 102 and communication device 144 of compactor machine 104. Communication device 150 may enable processor 146 to transmit a control signal to paving machine 102 and/or compactor machine 104, and/or transmit a data signal to paving machine 102 and/or compactor machine 104. For example, communication device 150 may be used to transmit an operating command, a location of paving machine 102, a location of compactor machine 104, a site plan, a boundary map of the work surface, and/or the like. Communication device 150 may also enable processor 146 to receive a data signal from paving machine 102 and/or compactor machine 104. For example, communication device 150 may be used to receive information identifying a location of paving machine 102, information identifying a location of compactor machine 104, a boundary map of the work surface provided by paving machine 102, and/or the like.

Control station 106 may be capable of receiving, generating, storing, processing, routing, and/or providing information for operating and/or guiding paving machine 102 and/or compactor machine 104 during the paving operation. For example, control station 106 may include a computing device (e.g., a desktop computer, a tablet computer, a handheld computer, a desktop computer, a smart phone, and/or the like). In another example, control station 106 may include a server device that is in communication with paving machine 102, compactor machine 104, and/or one or more additional control stations 106. Control station 106 may serve as an alternative or supplemental command center for processing control signals and/or data signals relating to the paving operation. For example, control station 106 may enable an operator to locally or remotely control paving machine 102 and/or compactor machine 104, monitor progress of the paving machine 102 and/or compactor machine 104, view a map of the work surface, access a boundary map, and/or the like. In some examples, control station 106 may be implemented separately from paving machine 102 and compactor machine 104, and/or implemented as part of one or more of paving machine 102 or compactor machine 104.

The number and arrangement of components shown in FIG. 1 are provided as an example. In practice, there may be additional components, fewer components, different components, or differently arranged components than those shown in FIG. 1. Furthermore, two or more components shown in FIG. 1 may be implemented within a single component, or a single component shown in FIG. 1 may be implemented as multiple, distributed components. Additionally, or alternatively, a set of components (e.g., one or more components) of FIG. 1 may perform one or more functions described as being performed by another set of devices of FIG. 1.

Figure 2:
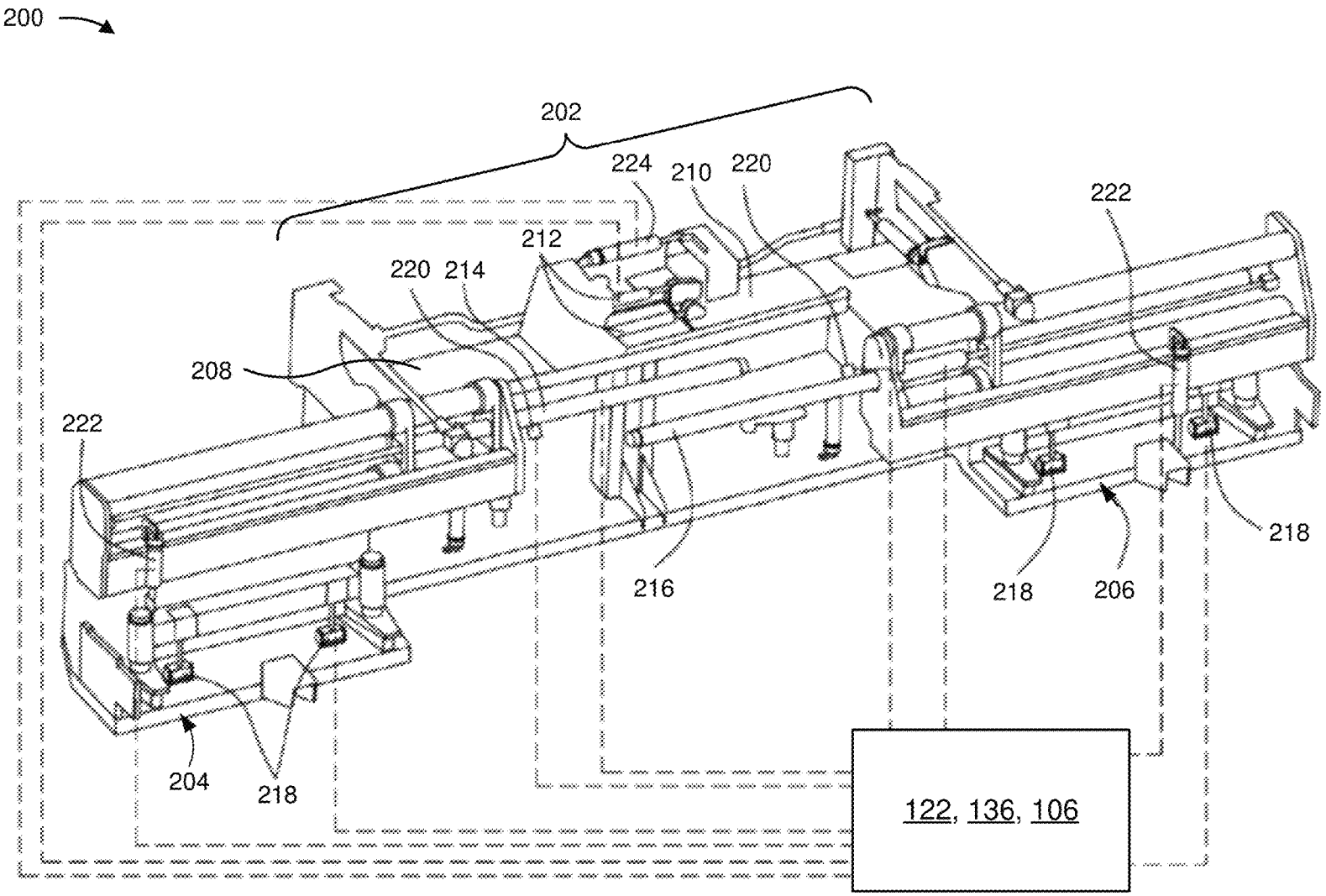
FIG. 2 is a diagram of an example screed of a paving machine described herein.

FIG. 2 is a diagram of an example screed 200 of paving machine 102 described herein. As shown in FIG. 2, screed 200 includes a main section 202, a first extension 204, and a second extension 206. Main section 202 may include a first plate 208 and a second plate 210 that are pivotally coupled together to form a variable crown angle. First extension 204 may be coupled to a first end of main section 202, and second extension 206 may be coupled to a second end of main section 202. One or more of first extension 204 and second extension 206 may be laterally movable relative to main section 202 so as to adjust an effective screed width and provide mats of varying widths. One or more of main section 202, first extension 204, or second extension 206 may also be vertically movable so as to adjust an effective screed height and provide mats of varying thicknesses.

Screed 200 may also include one or more actuator devices configured to adjust a position of main section 202, first extension 204, and/or second extension 206. For example, screed 200 may include a crown actuator 212 that is coupled to first plate 208 and second plate 210, and configured to selectively adjust a crown angle formed between first plate 208 and second plate 210. In another example, screed 200 may include a first width actuator 214 that is configured to extend or retract first extension 204 relative to main section 202, and a second width actuator 216 that is configured to extend or retract second extension 206 relative to main section 202. Screed 200 may also include a height actuator 218 configured to raise or lower first extension 204 and/or second extension 206. Crown actuator 212, first width actuator 214, second width actuator 216, and/or height actuator 218 may be controlled via paving control unit 122, compactor control unit 136, and/or control station 106.

Screed 200 may further include one or more sensor devices configured to monitor a position of main section 202, first extension 204, and/or second extension 206. For example, screed 200 may include a set of position sensors 220 configured to measure positions of first extension 204 and second extension 206 relative to main section 202. In some cases, screed 200 may also include a set of height sensors 222 (e.g., position sensors, and/or the like) configured to measure a screed height, and/or a crown sensor 224 configured to measure a crown angle between first plate 208 and second plate 210. One or more of position sensors 220, height sensors 222, or crown sensor 224 may be implemented using a positioning sensing cylinder, a hydraulic flow rate sensor, a linear encoder, a wire-rope sensor, a barometer, an accelerometer, an inertial measurement unit (IMU), an RF or another ranging device, an optic sensor, and/or another device suited to measure a change in position. Sensor data may be output via one or more sensor signals to paving control unit 122, compactor control unit 136, and/or control station 106. In some examples, a vision-based component may be used to measure screed width, screed height, crown angle, and/or the like. The vision-based component may be provided on paving machine 102, compactor machine 104, a local control station 106, and/or another work machine.

As indicated above, FIG. 2 is provided as an example. Other examples may differ from what was described in connection with FIG. 2.

Figure 3:
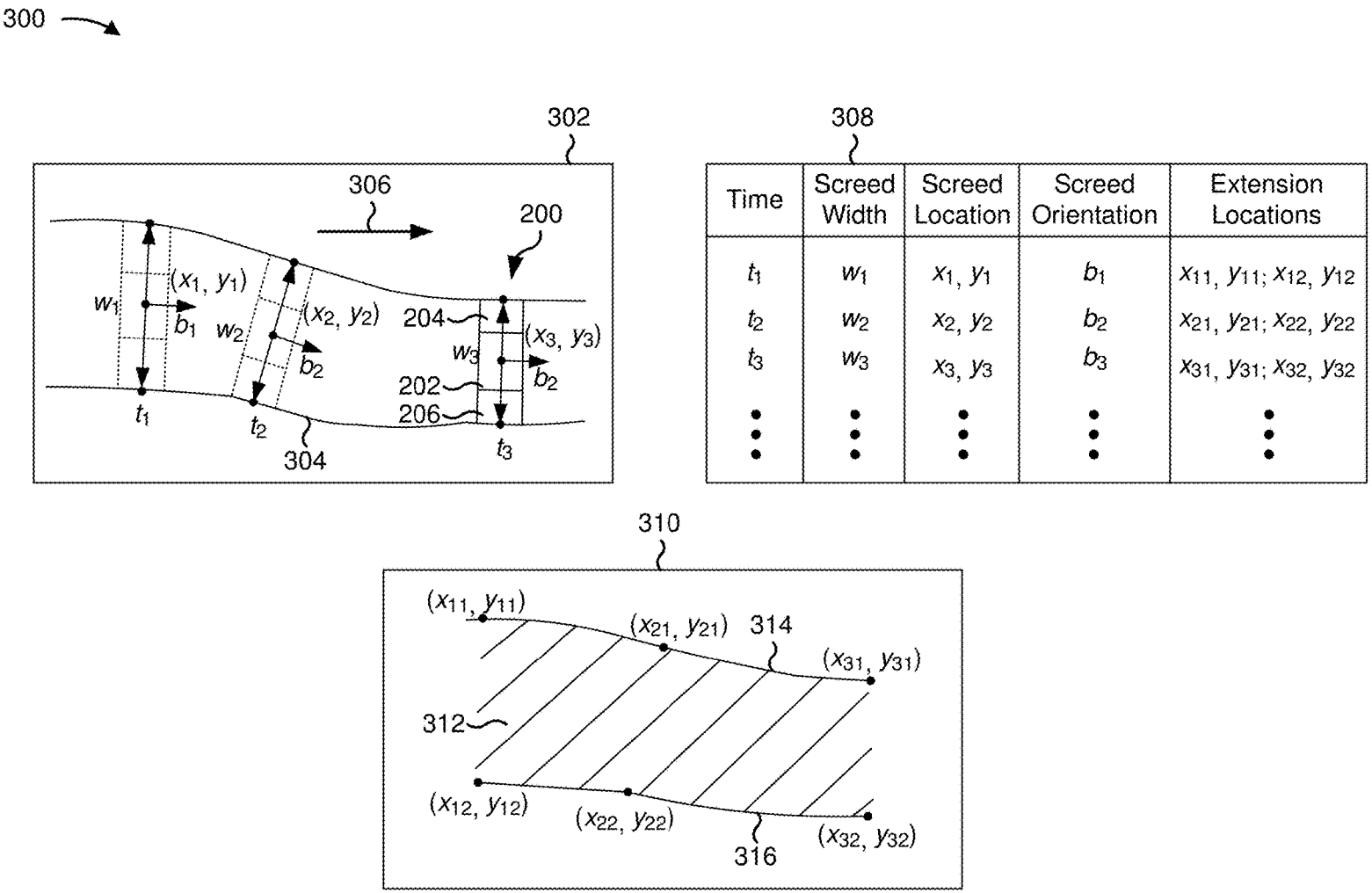
FIG. 3 is a diagram of an example implementation of a paving system described herein.

FIG. 3 is a diagram of an example implementation 300 of a paving system 100 described herein. As shown by reference number 302, and as illustrated as a top plan view, a particular work surface 304 may have varying widths (e.g., $w_1>w_2>w_3$). As paving machine 102 (e.g., represented by screed 200) proceeds along work surface 304 (e.g., in the direction indicated by arrow 306), the screed width may be adjusted (e.g., progressively retracted) to account for the narrowing width of work surface 304. For example, first extension 204 and second extension 206 may be autonomously or semi-autonomously retracted (e.g., via first width actuator 214 and second width actuator 216) to adjust screed width. In other examples, first extension 204 and second extension 206 may be manually retracted (e.g., by an operator). In other configurations of work surface 304, first extension 204 and second extension 206 may be progressively extended or otherwise varied according to the width of work surface 304.

As shown by reference number 308, paving control unit 122 may receive autowidth input (e.g., screed width data $w_1$, $w_2$, $w_3$) at different times (e.g., $t_1$, $t_2$, $t_3$) of the paving operation. In some examples, the screed width data may be provided by position sensors 220 as position data corresponding to the positions of first extension 204 and second extension 206 relative to main section 202. In this case, paving control unit 122 may calculate the screed width based on a known width of main section 202 and the relative positions of first extension 204 and second extension 206. In another example, the screed width data provided by position sensors 220 may directly correspond to screed width and additional derivations may not be needed. Paving control unit 122 may be configured to receive screed width data continuously in real-time, periodically, or intermittently (e.g., when the screed width is adjusted). In some examples, compactor control unit 136 and/or control station 106 may be configured to receive screed width data from position sensors 220, and/or observe, measure, and/or derive the screed width data and send the screed width data to paving machine 102, another work machine, a network storage device, a network computing device, a cloud computing device, and/or the like.

As further shown by reference number 308, paving control unit 122 may receive location data corresponding to a location of screed 200 during the paving operation. For example, paving control unit 122 may use a component of communication device 130 (e.g., a GPS receiver, a GNSS receiver, a UTS component, an ATS component, a vision-based positioning component, an RF component, and/or the like) of paving machine 102 to obtain the location of paving machine 102 (e.g., $(x_1, y_1)$, $(x_2, y_2)$, $(x_3, y_3)$ in terms of geographical coordinates, and/or the like) corresponding to a particular time (e.g., $t_1$, $t_2$, $t_3$). The location data may also include an orientation of paving machine 102 (e.g., $b_1$, $b_2$, $b_3$ in terms of bearing, and/or the like). In some cases, paving control unit 122 may determine the location and the orientation of screed 200 based on the location data relating to paving machine 102. For example, paving control unit 122 may use the detected location of paving machine 102 as the location of screed 200, and use the orientation of paving machine 102 as the orientation of screed 200.

In some cases (e.g., where greater precision is desired or feasible), paving control unit 122 may distinguish the location of screed 200 from the location of paving machine 102. For example, the detected location of paving machine 102 may correspond to the location of a component of communication device 130 (e.g., a GPS receiver, a GNSS receiver, a UTS component, an ATS component, a vision-based positioning component, an RF component, and/or the like), which may be different from the location of screed 200. In such a case, paving control unit 122 may use a known relationship (e.g., relative position, orientation, and/or distance) between screed 200 and communication device 130 to derive the location and the orientation of screed 200. Paving control unit 122 may be configured to receive location data continuously in real-time, periodically, or intermittently (e.g., when the screed width is adjusted). In some examples, compactor control unit 136 and/or control station 106 may be configured to receive the location data from paving machine 102, and/or send the location data to paving machine 102, another work machine, a network storage device, a network computing device, a cloud computing device, and/or the like.

As further shown by reference number 308, paving control unit 122 may determine a location of first extension 204 and a location of second extension 206 during the paving operation. The location of first extension 204 may be defined as an outer edge of first extension 204 (e.g., corresponding to a first boundary of the mat), and the location of second extension 206 may be defined as an outer edge of second extension (e.g., corresponding to a second boundary of the mat). Paving control unit 122 may derive the location of first extension 204 (e.g., $(x_{11}, y_{11})$, $(x_{21}, y_{21})$, $(x_{31}, y_{31})$), and the location of second extension 206 (e.g., $(x_{12}, y_{12})$, $(x_{22}, y_{22})$, $(x_{32}, y_{32})$) based on the screed width (e.g., $w_1$, $w_2$, $w_3$), the screed location (e.g., $(x_1, y_1)$, $(x_2, y_2)$, $(x_3, y_3)$), and the screed orientation (e.g., $b_1$, $b_2$, $b_3$). For example, paving control unit 122 may project geographical coordinates of the outer edges of first extension 204 and second extension 206 by superimposing the screed width onto the screed location and aligning the screed width to the screed orientation.

In other examples, paving control unit 122 may determine the locations of first extension 204 and second extension 206 using other analyses. For example, a location sensing device (e.g., a GPS receiver, a GNSS receiver, a UTS component, an ATS component, a vision-based positioning component, an RF component, and/or the like) may be disposed on the outer edge of one of first extension 204 or second extension 206. In this example, paving control unit 122 may directly detect the location of one of first extension 204 or second extension 206 using the location sensing device, and derive the location of the remaining one of first extension 204 or second extension 206 based on the screed width and the screed orientation. In some examples, location sensing devices may be disposed on the outer edges of both first extension 204 and second extension 206, and paving control unit 122 may directly detect the locations of both first extension 204 and second extension 206 using the location sensing devices. In some examples, compactor control unit 136 and/or control station 106 may determine the locations of first extension 204 and second extension 206.

As shown by reference number 310, and as illustrated as a top plan view, paving control unit 122 may generate a boundary map 312 of the mat based on the locations of first extension 204 and second extension 206. For example, paving control unit 122 may interpolate a change in the location of first extension 204 (e.g., based on $(x_{11}, y_{11})$, $(x_{21}, y_{21})$, $(x_{31}, y_{31})$), and determine a first boundary 314 of the boundary map 312 based on the interpolation. Similarly, paving control unit 122 may interpolate a change in the location of second extension 206 (e.g., based on $(x_{12}, y_{12})$, $(x_{22}, y_{22})$, $(x_{32}, y_{32})$), and determine a second boundary 316 of the boundary map 312 based on the interpolation. Boundary map 312 may be generated as a series of geographical coordinates corresponding to first boundary 314, second boundary 316, and/or an area between first boundary 314 and second boundary 316. In some cases, boundary map 312 may be generated as a two-dimensional digital model or a three-dimensional digital model of the mat or paved work surface 304.

In some cases, paving control unit 122 may transmit boundary map 312 (e.g., in real-time) to compactor machine 104 to guide compactor machine 104 along the paved work surface 304. In some autonomous or semi-autonomous applications, boundary map 312 may automatically restrict compactor machine 104 to within an area defined by boundary map 312. In some semi-autonomous or manual applications, boundary map 312 may be displayed in relation to work surface 304 (e.g., superimposed on a two-dimensional digital map or a three-dimensional digital map of work surface 304) and used by the operator to navigate compactor machine 104. In other examples, boundary map 312 may be configured to identify when compactor machine 104 deviates from boundary map 312 and trigger an alert or a notification indicative of the deviation.

In some cases, paving control unit 122 may use boundary map 312 as real-time feedback to guide operation of paving machine 102. In semi-autonomous or manual applications for instance, boundary map 312 may be graphically represented relative to work surface 304 and/or the site plan on a display of paving machine 102, and used by the operator to navigate paving machine 102. In some examples, boundary map 312 may be configured to identify when paving machine 102 deviates from work surface 304 and/or the site plan and cause an alert or a notification indicative of the deviation. In some examples, boundary map 312 may be similarly used in autonomous or semi-autonomous applications to help navigate paving machine 102. In some other applications, paving control unit 122 may transmit boundary map 312 to supply machine 108 to aid the operator of supply machine 108 in delineating between paved and unpaved sections of work surface 304.

In some cases, paving control unit 122 may use boundary map 312 to facilitate other assessments of the paving operation. In some examples, boundary map 312, and information associated with boundary map 312, may be used to determine a yield of paving machine 102 (e.g., an amount or volume of paving material used, and/or the like). For instance, paving control unit 122 may use a mat thickness, a crown angle, and the area of defined by boundary map 312 to calculate the yield of paving material used. The mat thickness and/or the crown angle may be obtained from a corresponding sensor (e.g., height sensors 222 and/or crown sensor 224) of paving machine 102. In some examples, the mat thickness and/or the crown angle may be obtained from a corresponding setting or parameter provided by the operator (e.g., based on a screed height and/or a crown angle manually input into user interface 128 of paving machine 102). In some examples, the mat thickness and/or the crown angle may be obtained from data signals provided by control station 106, and/or the like.

Paving control unit 122 may transmit boundary map 312, the yield, and/or another assessment of the paving operation to control station 106 and/or supply machine 108. Paving control unit 122 may update boundary map 312, the yield, and/or another assessment continuously in real-time, periodically, or intermittently (e.g., when the screed width is adjusted, when a direction of travel changes, and/or the like). In some applications, compactor control unit 136 and/or control station 106 may generate boundary map 312 based on data received from paving machine 102. Boundary map 312 may be accessible by paving machine 102, compactor machine 104, control station 106, and/or another device or work machine of paving system 100. Boundary map 312 may be used by one or more of paving machine 102, compactor machine 104, or control station 106 to enable other assessments of the paving operation and/or to guide one or more of paving machine 102, compactor machine 104, and/or another work machine.

As indicated above, FIG. 3 is provided as an example. Other examples may differ from what is described in connection with FIG. 3.

Figure 4:
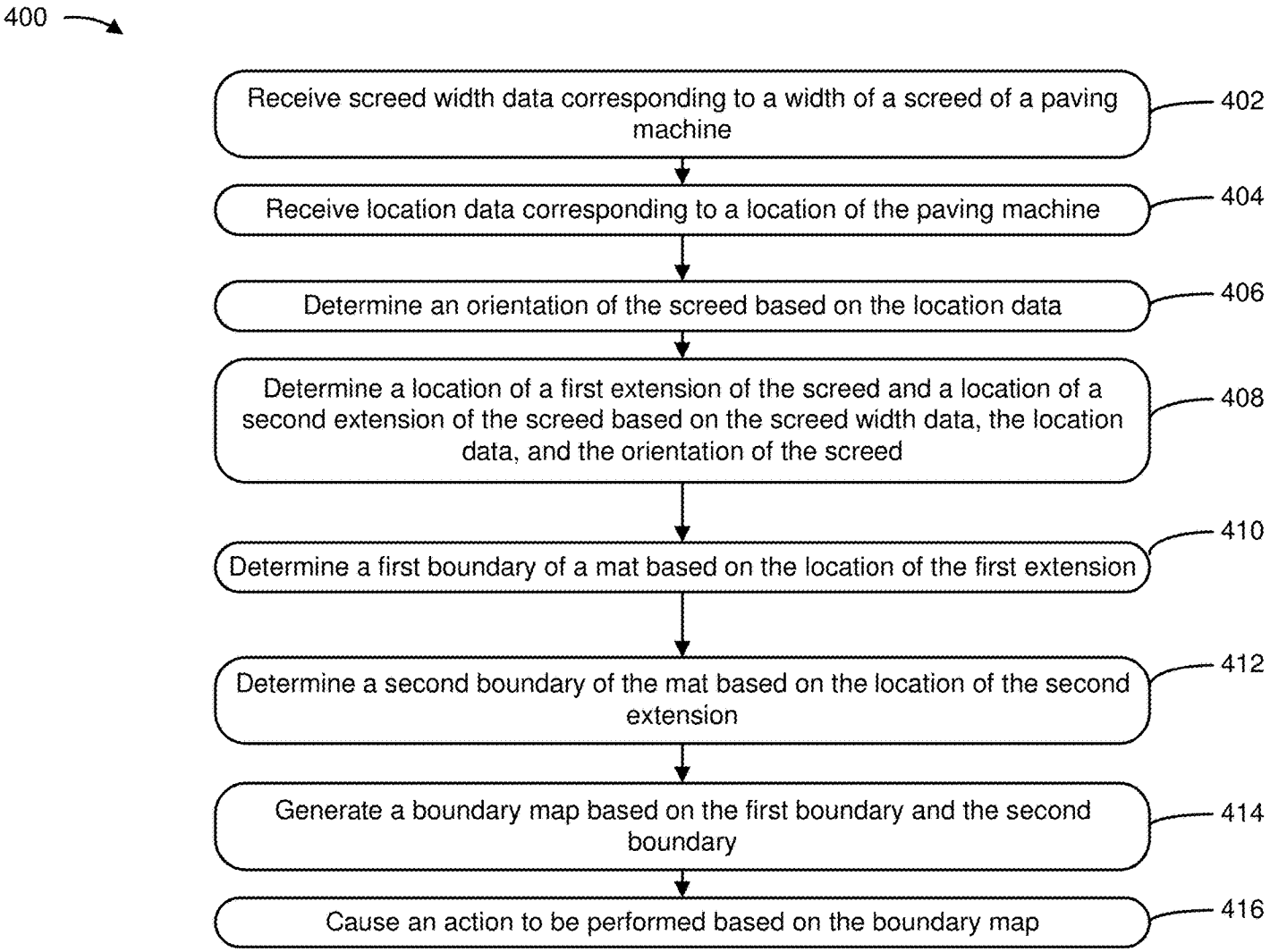
FIG. 4 is a flow chart of an example process for using a boundary map based on autowidth input.

FIG. 4 is a flow chart of an example process 400 for using a boundary map based on autowidth input. One or more process blocks of FIG. 4 may be performed by a paving control unit (e.g., paving control unit 122 of paving machine 102) and/or by another component or a group of components separate from or including the paving control unit (e.g., compactor control unit 136 of compactor machine 104 and/or control station 106).

As shown in FIG. 4, process 400 may include receiving screed width data corresponding to a width of a screed of a paving machine (block 402). For example, the paving control unit (e.g., using processor 124, memory 126, communication device 130, and/or the like) may receive screed width data from position sensors 220 corresponding to the width of screed 200, as described above.

As further shown in FIG. 4, process 400 may include receiving location data corresponding to a location of the paving machine (block 404). For example, the paving control unit (e.g., using processor 124, memory 126, communication device 130, and/or the like) may receive the location of paving machine 102, as described above.

As further shown in FIG. 4, process 400 may include determining an orientation of the screed based on the location data (block 406). For example, the paving control unit (e.g., using processor 124, memory 126, communication device 130, and/or the like) may determine the orientation of screed 200 based on an orientation of paving machine 102 and a relationship between screed 200 and paving machine 102, as described above.

As further shown in FIG. 4, process 400 may include determining a location of a first extension of the screed and a location of a second extension of the screed based on the screed width data, the location data, and the orientation of the screed (block 408). For example, the paving control unit (e.g., using processor 124, memory 126, communication device 130, and/or the like) may determine the location of first extension 204 and the location of second extension 206 based on the width of screed 200, the location of paving machine 102, and the orientation of screed 200, as described above.

As further shown in FIG. 4, process 400 may include determining a first boundary of a mat based on the location of the first extension (block 410). For example, the paving control unit (e.g., using processor 124, memory 126, communication device 130, and/or the like) may determine first boundary 314 of the mat based on the location of the first extension 204, as described above.

As further shown in FIG. 4, process 400 may include determining a second boundary of the mat based on the location of the second extension (block 412). For example, the paving control unit (e.g., using processor 124, memory 126, communication device 130, and/or the like) may determine second boundary 316 of the mat based on the location of the second extension 206, as described above.

As further shown in FIG. 4, process 400 may include generating a boundary map based on the first boundary and the second boundary (block 414). For example, the paving control unit (e.g., using processor 124, memory 126, communication device 130, and/or the like) may generate boundary map 312 based on first boundary 314 and second boundary 316, as described above.

As further shown in FIG. 4, process 400 may include causing an action to be performed based on the boundary map (block 416). For example, the paving control unit (e.g., using processor 124, memory 126, communication device 130, and/or the like) may cause an action to be performed based on boundary map 312, as described above.

Process 400 may include variations and/or additional implementations to those described in connection with FIG. 4, such as any single implementation or any combination of implementations described elsewhere herein. Although FIG. 4 shows example blocks of process 400, in some examples, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

A paving machine may be provided with a screed assembly having a variable width screed to accommodate a work surface having varying widths. The effective screed width may be adjusted using actuators to extend or retract extenders on each end of the screed. In some situations, such as in autonomous or semi-autonomous applications, it may be useful to track changes to the screed width and to know the actual screed width at a given time or location of the paving operation. For instance, the screed width can be used to more precisely guide a compactor machine or another work machine, and/or make useful assessments of the paving operation. To be useful, however, the screed width inputs should be current and reliable.

The autowidth input techniques described herein enable real-time screed width input, and leverage the screed width input to further facilitate and enhance the paving operation. For example, the present disclosure uses position sensors on the screed and location data of the paving machine to track the screed width and corresponding locations of the screed extensions in real-time. Based on the locations of the screed extensions, the present disclosure generates a boundary map that defines the location and dimensions of the mat. Using the boundary map, the present disclosure is able to operate and/or guide the paving machine, the compactor machine, and/or another work machine, track yield of paving material, and/or determine other aspects that can be used to manage the paving operation.

Accordingly, by leveraging position sensors and location data to measure screed width, the present disclosure provides for a more reliable and real-time screed width input. Reliable and real-time data enables the present disclosure to make more precise assessments about a paving operation (e.g., boundary maps, yield, and/or the like). Having precise assessments further enables the present disclosure to operate or guide work machines more precisely and efficiently. By operating work machines more precisely, the present disclosure reduces the potential for errors as well as delays associated with correcting such errors. By operating work machines more efficiently, the present disclosure can conserve resources (e.g., fuel) and reduce unnecessary wear on the work machines.

What is claimed is:

1. A method, comprising:

receiving, by a device, screed width data corresponding to a width of a screed of a paving machine;

receiving, by the device, location data corresponding to a location of the paving machine;

determining, by the device, an orientation of the screed based on the location data;

determining, by the device, a location of a first extension of the screed based on the screed width data, the location data, and the orientation of the screed;

determining, by the device, a location of a second extension of the screed based on the screed width data, the location data, and the orientation of the screed;

determining, by the device, a first interpolation based on a change in the location of the first extension;

determining, by the device, a first boundary of a mat based on the first interpolation;

determining, by the device, a second interpolation based on a change in the location of the second extension;

determining, by the device, a second boundary of the mat based on the second interpolation;

generating, by the device, a boundary map based on the first boundary and the second boundary; and causing, by the device, an action to be performed based on the boundary map.

2. The method of claim 1, wherein receiving the screed width data comprises:

receiving sensor data corresponding to a position of the first extension relative to a main section of the screed and a position of the second extension relative to the main section of the screed; and determining the width of the screed based on the position of the first extension, the position of the second extension, and a relationship between the first extension, the second extension, and the main section.

3. The method of claim 1, wherein determining the location of the first extension comprises:

determining a location of the screed based on the orientation of the screed, the location of the paving machine, and a relationship between the screed and the paving machine; and determining the location of the first extension based on the location of the screed and the width of the screed; and wherein determining the location of the second extension comprises:

determining the location of the second extension based on the location of the screed and the width of the screed.

4. The method of claim 1, wherein the device is a paving control unit of the paving machine, and wherein causing the action to be performed comprises:

transmitting the boundary map to a compactor machine to cause the compactor machine to operate according to the boundary map.

5. The method of claim 1, wherein causing the action to be performed comprises:

transmitting the boundary map to one or more of the paving machine or a second work machine to cause the one or more of the paving machine or the second work machine to operate according to the boundary map.

6. The method of claim 1, wherein causing the action to be performed comprises:

receiving a mat thickness from the paving machine;

receiving a crown angle from the paving machine; and determining a yield of the paving machine based on the mat thickness, the crown angle, and the boundary map.

7. The method of claim 1, wherein causing the action to be performed comprises:

identifying a deviation between the boundary map and a site plan; and communicating the deviation to a user interface associated with the paving machine.

8. The method of claim 1, wherein receiving the screed width data comprises:

receiving the screed width data from one or more of a compactor machine or a control station in communication with the paving machine.

9. A device, comprising:

one or more memories; and one or more processors, communicatively coupled to the one or more memories, to:

receive screed width data corresponding to a width of a screed of a paving machine;

receive location data corresponding to a location of the paving machine;

determine a location of a first extension of the screed based on the screed width data and the location data;

determine a location of a second extension of the screed based on the screed width data and the location data;

determine a first interpolation based on a change in the location of the first extension;

determine a first boundary of a mat based on the first interpolation;

determine a second interpolation based on a change in the location of the second extension;

determine a second boundary of the mat based on the second interpolation;

generate a boundary map based on the first boundary and the second boundary; and cause an action to be performed based on the boundary map.

10. The device of claim 9, wherein the one or more processors, when determining the location of the first extension, are to:

determine a location of the screed based on the location of the paving machine and a relationship between the screed and the paving machine; and determine the location of the first extension based on the location of the screed and the width of the screed; and wherein the one or more processors, when determining the location of the second extension, are to:

determine the location of the second extension based on the location of the screed and the width of the screed.

11. The device of claim 9, wherein the one or more processors, when determining the first boundary of the mat, are to:

determine a first set of geographical coordinates corresponding to the first boundary; and wherein the one or more processors, when determining the second boundary of the mat, are to:

determine a second set of geographical coordinates corresponding to the second boundary.

12. The device of claim 9, wherein the one or more processors, when causing the action to be performed, are to:

transmit the boundary map to one or more of the paving machine or a second work machine to cause the one or more of the paving machine or the second work machine to operate according to the boundary map.

13. The device of claim 9, wherein the one or more processors, when causing the action to be performed, are to:

receive a mat thickness;

receive a crown angle; and determine a yield of the paving machine based on the mat thickness, the crown angle, and the boundary map.

14. A paving machine, comprising:

a frame;

a screed coupled to the frame, the screed having a main section, a first extension movably coupled to a first end of the main section, and a second extension movably coupled to a second end of the main section;

a set of sensor devices coupled to the screed, the set of sensor devices being configured to output a first sensor signal corresponding to a position of the first extension relative to the main section and a second sensor signal corresponding to a position of the second extension relative to the main section; and a control unit in communication with the set of sensor devices, the control unit being configured to:

receive the first sensor signal and the second sensor signal, determine a screed width based on the first sensor signal and the second sensor signal, receive location data corresponding to a location of the paving machine, determine a location of the first extension based on the screed width and the location data, determine a location of the second extension based on the screed width and the location data, determine a first interpolation based on a change in the location of the first extension, determine a second interpolation based on a change in the location of the second extension, generate a boundary map based on the first interpolation and the second interpolation, and cause an action to be performed based on the boundary map.

15. The paving machine of claim 14, wherein the control unit, when determining the screed width, is to:

determine the screed width based on the position of the first extension relative to the main section, the position of the second extension relative to the main section, and a width of the main section.

16. The paving machine of claim 14, wherein the control unit, when determining the location of the first extension, is to:

determine a first set of geographical coordinates corresponding to the location of the first extension, and wherein the control unit, when determining the location of the second extension, is to:

determine a second set of geographical coordinates corresponding to the location of the second extension.

17. The paving machine of claim 14, wherein the control unit, when causing the action to be performed, is to:

identify a deviation between the boundary map and a site plan, and communicate the deviation to a user interface associated with the paving machine.

18. The paving machine of claim 14, wherein the control unit, when causing the action to be performed, is to:

transmit the boundary map to a compactor machine to cause the compactor machine to operate according to the boundary map.

19. The paving machine of claim 14, wherein the control unit, when causing the action to be performed, is to:

receive a mat thickness, receive a crown angle, and determine a yield of the paving machine based on the mat thickness, the crown angle, and the boundary map.

20. The paving machine of claim 14, wherein the boundary map is a two-dimensional digital model or a three-dimensional digital model of a mat or a paved work surface.

* * * * *